US007665785B1

(12) United States Patent
Newton et al.

(10) Patent No.: US 7,665,785 B1
(45) Date of Patent: Feb. 23, 2010

(54) COLUMN PIPE CATCH TOOL

(76) Inventors: Paul A. Newton, 1208 N. Jerrick Rd., Belle Plaine, KS (US) 67013; Daniel J. Phillippi, 1517 N. Santa Fe, Wichita, KS (US) 67214

( * ) Notice: Subject to any disclaimer, the term of this patent is extended or adjusted under 35 U.S.C. 154(b) by 0 days.

(21) Appl. No.: 12/420,623

(22) Filed: Apr. 8, 2009

(51) Int. Cl.
*B66C 1/48* (2006.01)

(52) U.S. Cl. ..... 294/86.29; 294/113

(58) Field of Classification Search ..... 294/86.26, 294/86.27, 86.29, 86.3, 86.31, 110.1, 113, 294/114, 901
See application file for complete search history.

(56) References Cited

U.S. PATENT DOCUMENTS 1,172,180 A * 2/1916 Trevino ..... 294/86.29
1,542,099 A * 6/1925 Rogers ..... 294/86.29
1,558,902 A * 10/1925 Ligon ..... 294/86.29
2,006,949 A * 7/1935 Hockensmith ..... 294/114
2,675,263 A * 4/1954 Jennings et al. ..... 294/86.11
3,112,038 A * 11/1963 Breivik ..... 414/788.2
3,653,708 A * 4/1972 Merola ..... 294/102.1
3,926,468 A * 12/1975 Kondo ..... 294/102.1
4,671,724 A * 6/1987 Bolton ..... 414/798

* cited by examiner

*Primary Examiner*—Dean J Kramer
(74) *Attorney, Agent, or Firm*—Kenneth H. Jack; Davis & Jack, L.L.C.

(57) ABSTRACT

A catch tool for retrieval of a well column pipe having a pipe wall, the catch tool incorporating a fork having a pair of spaced tines; and a pair of clamping pivot arms connected operatively to the fork, the clamping arms being adapted for, upon the receipt by the tines of the pipe wall, grasping the pipe wall; the clamping arms having proximal and distal ends, the arms being adapted for pivoting movements between first and second positions, the arms' distal ends being displaced away from each other a distance less than the pipe wall's thickness dimension while in the first position, and being carried by the pipe wall to their second positions.

12 Claims, 8 Drawing Sheets

COLUMN PIPE CATCH TOOL

FIELD OF THE INVENTION

This invention relates to apparatus, mechanism, and assemblies utilized in water well construction, restoration, and maintenance. More particularly, this invention relates to such apparatus, assemblies, and mechanisms which are specially adapted for retrieving broken or disconnected column pipes which may upon occasion reside within such wells.

BACKGROUND OF THE INVENTION

In the water well construction, repair, and maintenance art, it is known that water well's column pipe may upon occasion break or disconnect at a joint at a subterranean location within the well's bore. Such breakage or disconnection undesirably strands a length of column pipe, and often strands an attached submersible electric water pump at the bottom of the well. In such disadvantageous circumstances, it is typically desirable to attempt to retrieve the well column pipe and attached pump in order to salvage the pump and to effectuate pipe replacement or pipe repairs.

In many cases, the upper end of such broken or disconnected well column pipe lies at an elevation several feet below the upper opening of the well casing, making it very difficult for an operator to grasp and retrieve the well column pipe. To accommodate for such difficulty, the instant inventive well column pipe catch tool provides a specialized forked bracket which may be lowered into a water well bore for contact and secure engagement with such broken or disconnected well column pipe, and for upward hoisting and retrieval of such well column pipe.

BRIEF SUMMARY OF THE INVENTION

The instant inventive well column pipe catch tool is preferably utilized for and is fitted for attachment to and retrieval of a well column pipe having a pipe wall thickness dimension. The catch tool preferably comprises a fork having a pair of downwardly extending tines, such tines being fitted and spaced laterally apart for receipt of the thickness dimension of said pipe wall. Such lateral space preferably serves as a pipe wall receiving throat. The instant inventive catch tool preferably further comprises clamping means which are connected operatively to the fork or which comprise specialized configurations of components of the fork. The clamping means is preferably mechanically adapted for, upon upward receipt of such pipe wall between the fork's tines, securely grasping and holding such pipe wall.

In a preferred embodiment of the instant inventive catch tool, the clamping means comprises a pair of pivotally movable arms or cam members, each arm among said pair having a proximal end and having a distal end. In the preferred embodiment, each of the arms is fixedly and rotatably or pivotally attached to one of the fork's tines. Where pivotal arm motion is mechanically facilitated, the arms preferably are adapted for pivoting movements between first and second positions, the arms' laterally inwardly extending distal ends, or "wall biting" ends, being displaced laterally away from each other a distance slightly less than the pipe wall's thickness dimension while in first position. Upon upward receipt of an upper edge of the pipe wall between the tines of the fork, the arms' distal ends are preferably upwardly dragged or frictionally moved by inner and outer surfaces of the pipe wall to upwardly pivoted second positions.

In order to assure that the catch tool's pivot arms normally pivot to their downwardly oriented first positions in absence of any upwardly extending pipe wall therebetween, biasing means are preferably provided, such means preferably being mechanically associated with the arms. In a preferred embodiment of the instant invention, the biasing means are gravity actuated, and the preferred biasing means comprises weights which are fixedly attached to the arms for downwardly pivoting the arms. Suitably, though less desirably, spring biasing means may be alternatively utilized.

Also in a preferred embodiment of the instant inventive catch tool, the fork comprises a layering or stratification of first, second, and third sub-forks, each sub-fork comprising a pair of tines. In such embodiment, the sub-forks' tine pairs make up stratified layers the paired fork's tines. As with the fork, each of the sub-forks' paired tines are spaced apart to together define the fork's pipe wall receiving space. In such preferred embodiment, mounting means interconnecting the first, second, and third sub-forks are provided, such means slidably positioning the second and third sub-forks over opposite faces of the first sub-fork. Where such mounting means configuration is provided, the second and third sub-forks interstitially "sandwich" the first sub-fork. Also, such mounting means are preferably adapted for facilitating upward and downward motions of the second and third sub-forks between first and second positions which correspond with motions of the pivot arms with their first and second positions. In such preferred embodiment, the preferred pivot arm clamping means are connected operatively to the first, second, and third sub-forks so that they alternatingly open and close within the pipe wall receiving space between the tines upon sliding motions of the second and third forks between their first and second positions. To facilitate such motion, such mounting means preferably comprise a plurality of posts and a plurality of travel slots, each travel slot extending through the first sub-fork, each post spanning between and rigidly interconnecting the second and third sub-forks, and each post extending through one of the first sub-fork's travel slots. Also, to facilitate such motion, a specially configured laterally opposed pair of the travel slots extend through the tines of the first sub-fork, such travel slots further opening laterally inwardly toward the pipe wall receiving space. Each of such travel slots preferably has a specially configured laterally outer wall which presents a semi-circular bearing socket. In such embodiment, pivot bearings at the proximal ends of the mechanism's opposed pivot arms engage and rotate within such bearing sockets. The pivot arms preferably cantilever laterally inwardly from such pivot bearings and from such inwardly opening travel slots into the column pipe wall receiving space. Preferably, the pivot arms have sharp pointed wall biting distal ends, and such arms are, as discussed above, pivotally movable between first and second positions which correspond with sliding motions of the second and third sub-forks. Such corresponding pivotal motion is preferably mechanically actuated by extending a pair of the sub-fork interconnecting posts through eyes within the pivot arms. Preferably, the wall biting distal ends of the pivot arms move to an over center orientation with respect to the arms' pivot bearings upon upward extension of a pipe wall between the fork's tines.

In a preferred embodiment of the instant invention, the above referenced second and third sub-forks, along with their downwardly extending tines, advantageously further function (in addition to their function as biasing means) as cover plates which capture and hold the pivot arms' bearings within the first sub-fork's bearing sockets.

In use of the instant inventive catch tool, and assuming that a water well column pipe has become fractured or separated at a subterranean level substantially below the well's opening, a sturdy rope is preferably tied to an upper end of the first sub-fork component of the inventive tool. Thereafter, the catch tool is lowered by the rope into the well bore until the lower end of the tool reaches the level of the opening of the column pipe. Upon further lowering of the tool, the column pipe's upper edge or opening may extend upwardly into the pipe wall receiving space between the fork's tines. Repeated attempts at slightly raising and lowering the tool at and about the level of the column pipe's upper opening may be needed in order to cause such upward extension to occur. During the tines' receipt of the pipe wall, the fork's pivot arm clamping means are frictionally dragged in a pivotal fashion from their downwardly biased first positions to their upwardly pivoted and over center second positions. Thereafter, upon upward pulling upon such rope, the preferred pointed pipe wall biting distal ends of the pivot arms gouge into and frictionally and opposingly bind or clamp against inner and outer surfaces of the column pipe's wall, causing the tool to securely hold and capture the column pipe. Thereafter, pulling force applied to the rope hoists the column pipe upwardly through the well bore to the ground level.

Accordingly, it is an object of the instant invention to provide a catch tool which provides structural components and functional features, as described above, and wherein such components are arranged for the performance of beneficial functions, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
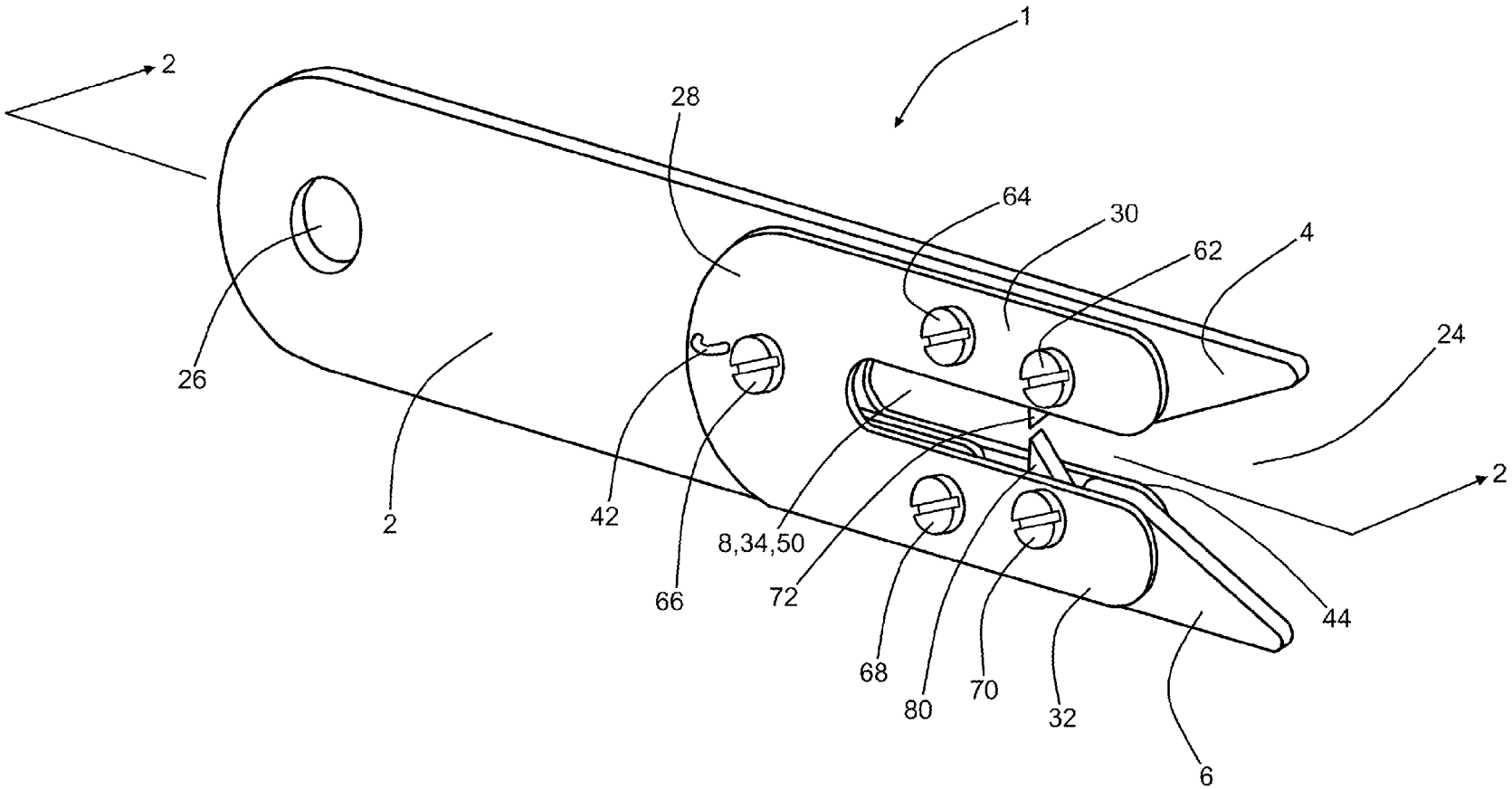
FIG. 1 is a perspective view of the instant inventive well column pipe catch tool.
Figure 2:
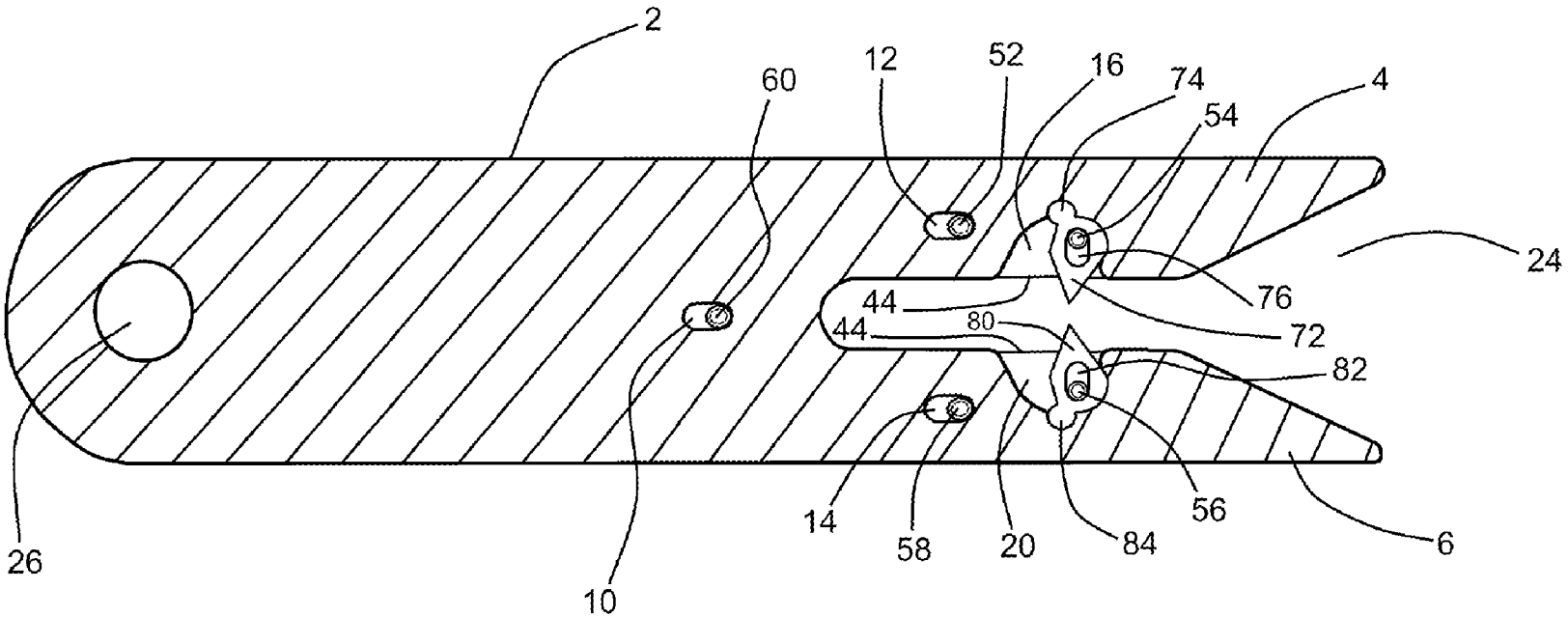
FIG. 2 is a sectional view as indicated in FIG. 1.
Figure 3:
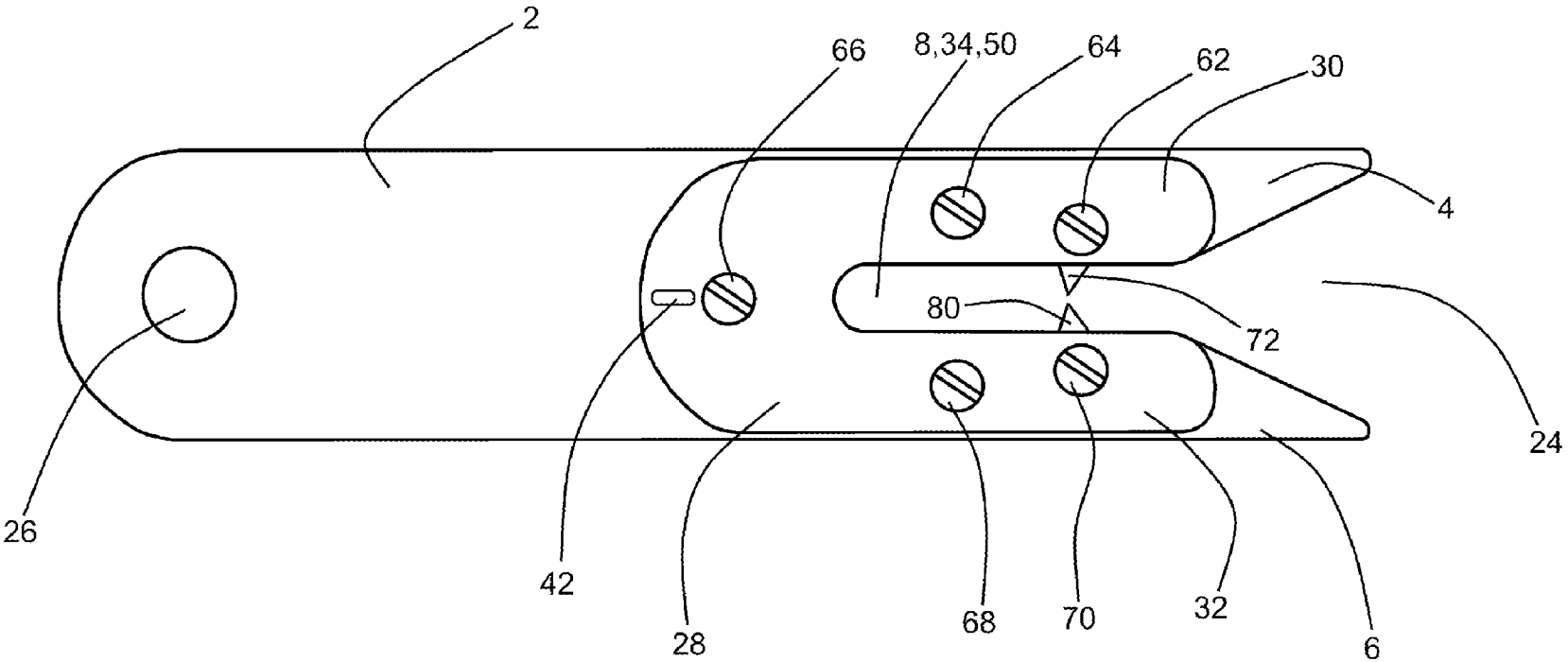
FIG. 3 is a plan view of the tool depicted in FIG. 1.
Figure 4:
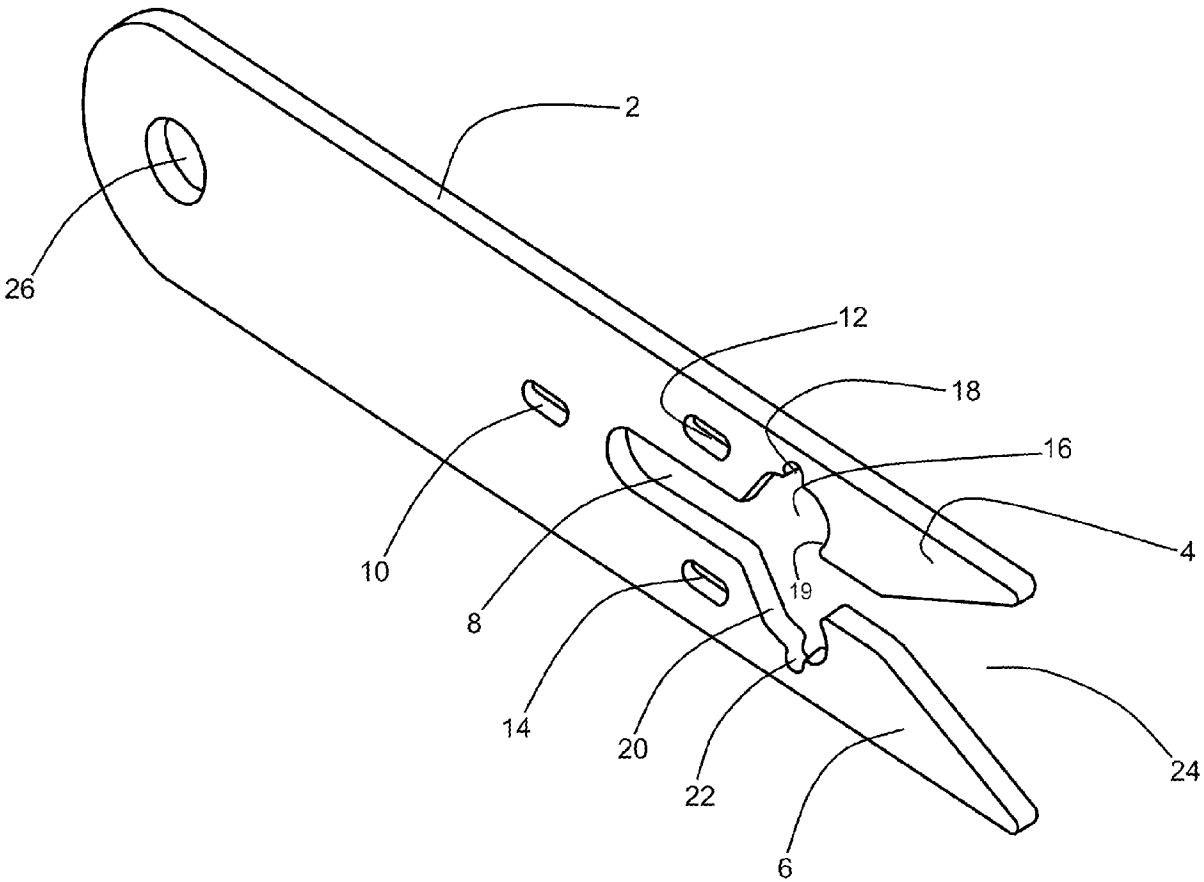
FIG. 4 is a perspective view of a disassembled first sub-fork or interstitial plate component of the instant inventive catch tool.
Figure 5:
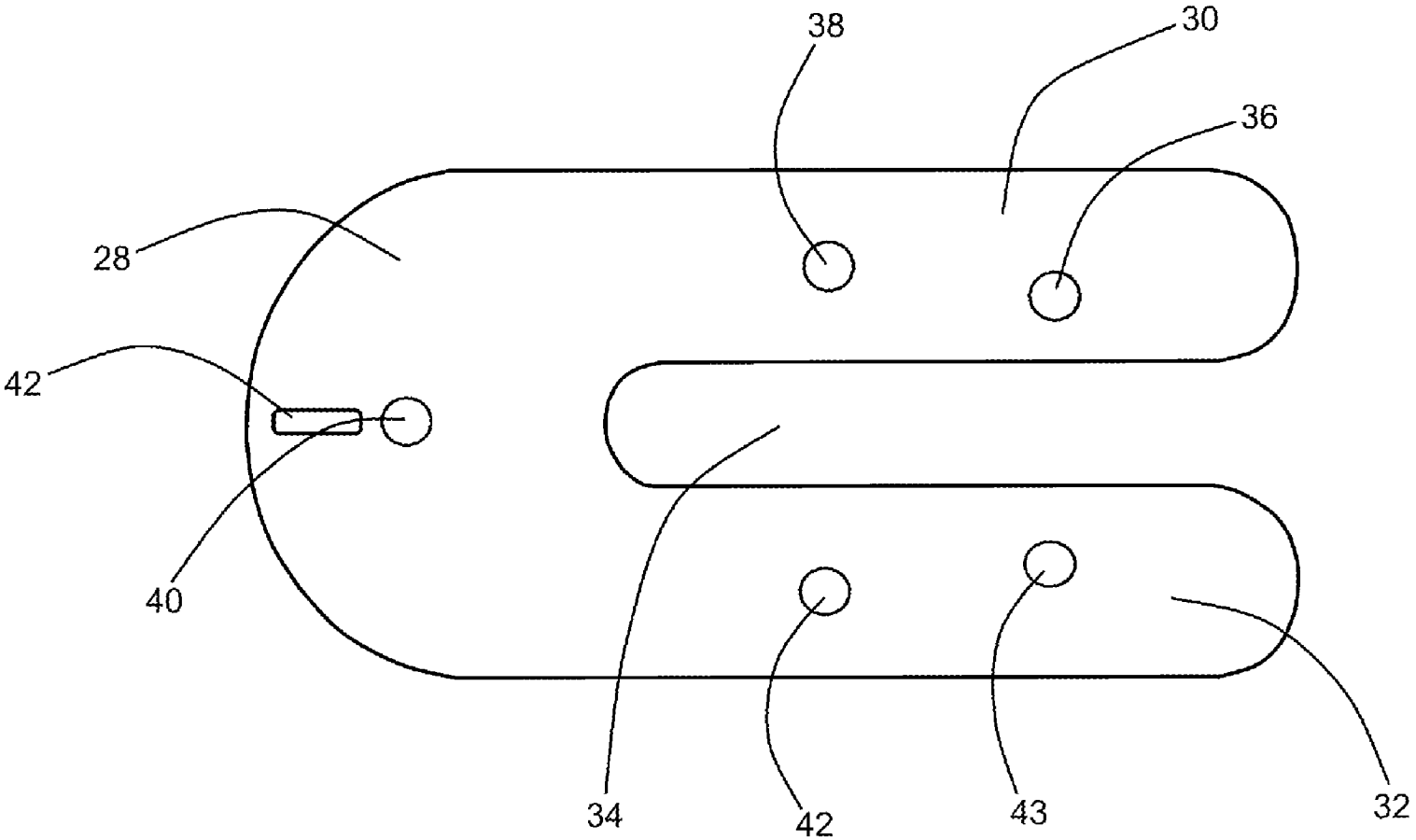
FIG. 5 is a plan view of a disassembled second sub-fork or cover plate component of the instant inventive catch tool.

Referring now to the drawings, and in particular to FIG. 1, the instant inventive well column pipe catch tool is referred to generally by Reference Arrow 1. A major structural component of the catch tool 1 comprises a fork having a pair of tines, the tines forming a flared lower opening 24.

Figure 6:
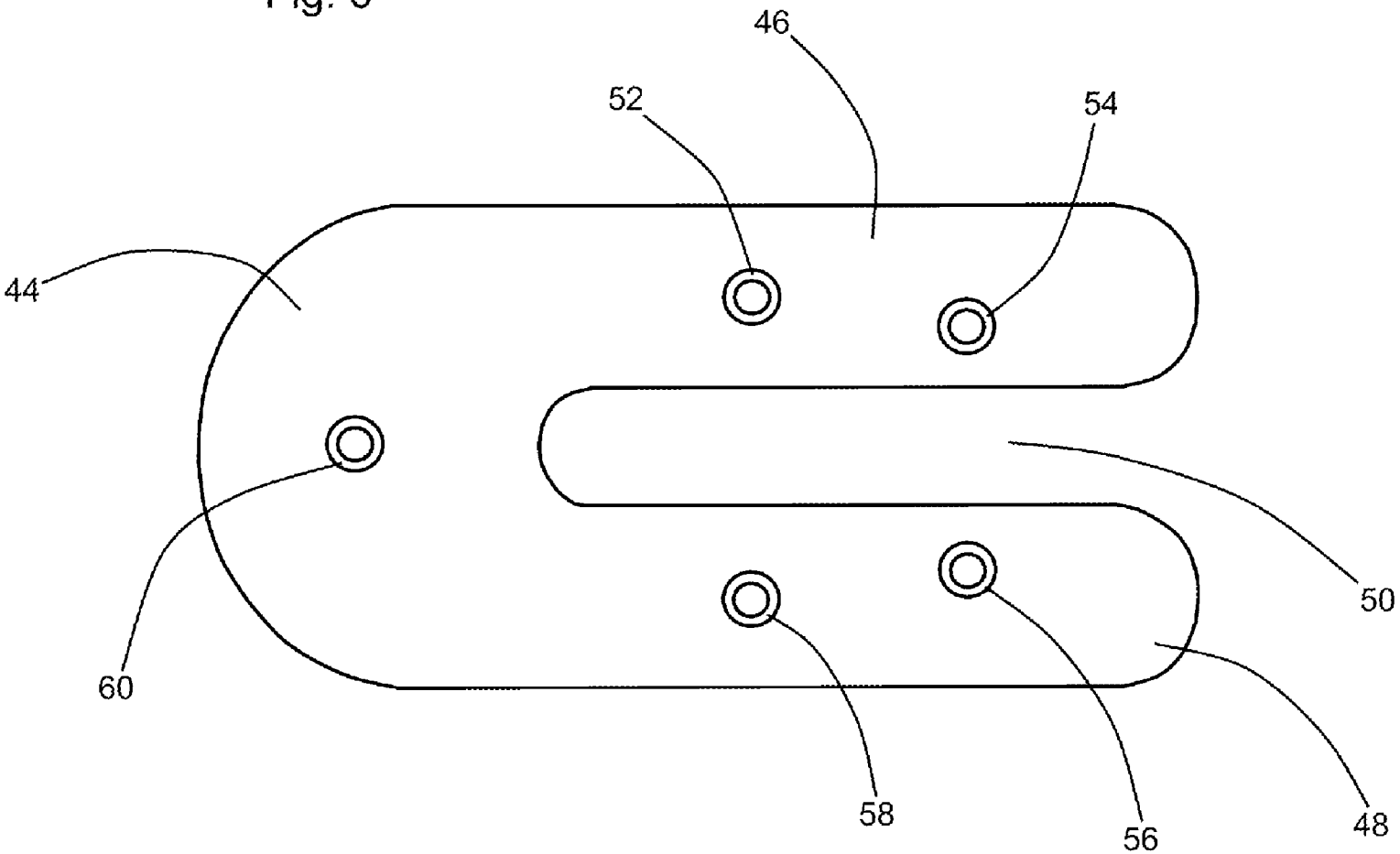
FIG. 6 is a plan view of a disassembled third sub-fork or cover plate component of the instant inventive catch tool.
Figure 7:
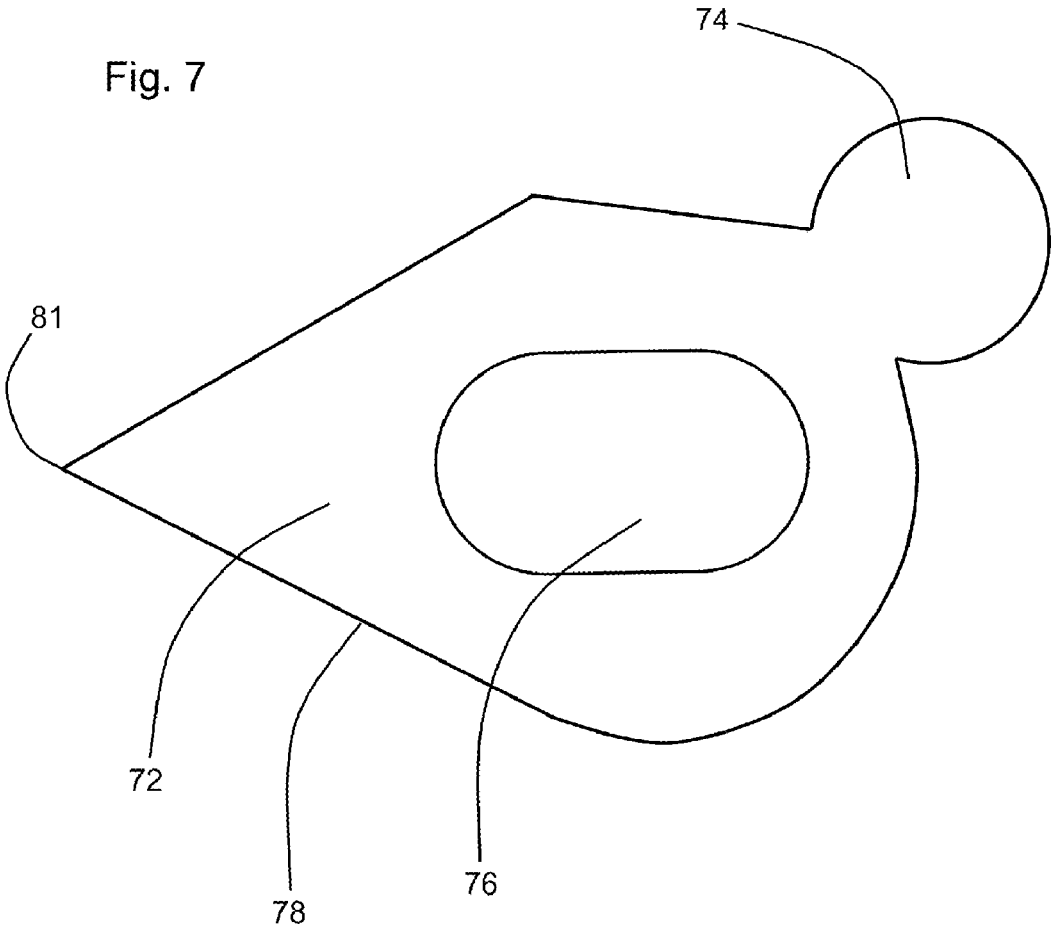
FIG. 7 is a plan view of a disassembled pivot arm component of the instant inventive catch tool.
Figure 8:
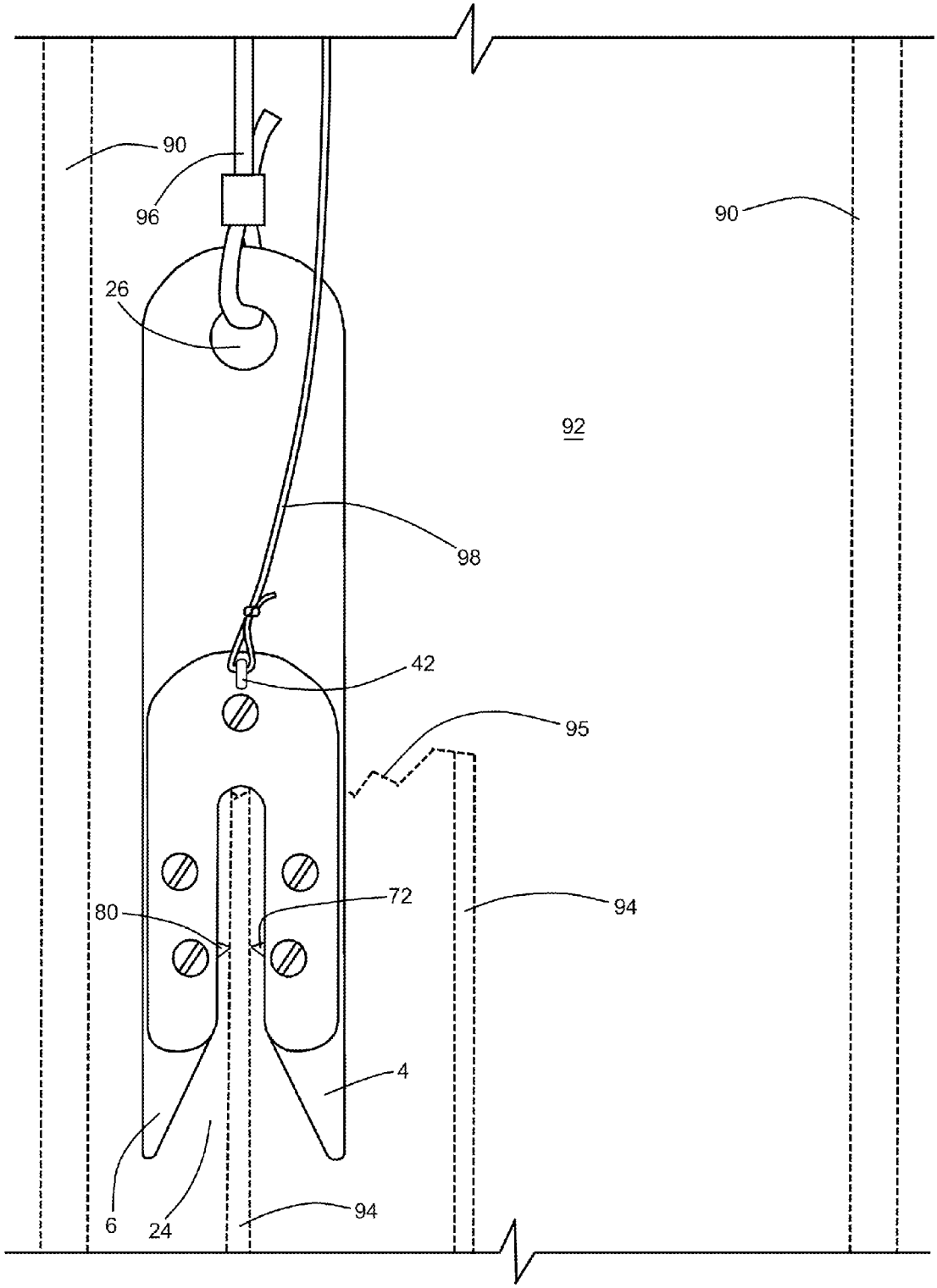
FIG. 8 redepicts FIG. 3, the view of FIG. 8 representationally showing the instant inventive catch tool in use.

The fork preferably comprises a stratification of plates including a first sub-fork or interstitial plate 2 having a pair of downwardly extending tines 4 and 6, a second sub-fork or cover plate 28 having a pair of downwardly extending tines 30 and 32, and (referring further simultaneously to FIG. 6) a third sub-fork or cover plate 44 having a pair of downwardly extending tines 46 and 48. Said sub-forks' downwardly extending tines 4, 6, 30, 32, 46, 48, together and in combination form a downwardly opening pipe wall receiving space 8,34,50, such space serving as a pipe wall receiving throat. Referring further simultaneously to FIG. 8, the pipe wall receiving space 8,34,50 is sized and fitted for free receipt of a pipe wall 94 at the broken upper end of a column pipe 95 within the bore 92 of a well casing 90.

Referring simultaneously to all figures, the instant inventive catch tool 1 further comprises clamping means whose components are connected operatively to the fork or comprise special configurations of fork components. The clamping means are preferably adapted for, upon receipt by the tines 4, 6, 30, 32, 46, 48 of such broken column pipe wall 94, securely grasping and holding such wall 94. Primary pipe wall grasping and engaging members of the clamping means comprise a pair of cam members or pivot arms 72 and 80, said pivot arms each having a semi-circular and cylindrical pivot bearing 74 or 84 at its proximal or outer end, and each having a sharply pointed pipe wall biting distal or inner end 80. The pivot arms 72 and 80 preferably further have laterally oblongated post receiving eyes 76 and 82.

Referring further to all figures, the clamping means preferably further comprises a configuration of the tines 4 and 6 of the first sub-fork/interstitial plate 2 to present a laterally opposed pair of vertical travel slots 16 and 20, each such slot opening laterally inwardly toward the pipe wall receiving space 8,34,50. The laterally outer walls of such travel slots 16 and 20 are preferably specially configured to further present inwardly opening semi-circular bearing sockets 18 and 22, such sockets respectively rotatably receiving the bearings 74 and 84 of the pivot arms 72 and 80. Upon downward pivoting of the pivot arms 72 and 80 within the travel slots 16 and 20, the lower surfaces 78 of the pivot arms 72 and 80 contact and stop against lower surfaces 19 of the travel slots 16 and 20. Such downwardly pivoted and stopped orientations of the pivot arms 72 and 80 constitute a first pivot arm position.

Referring further to all figures, the distal or inner wall biting ends 81 of the pivot arms 72 and 80 and are preferably positioned so that, while the arms are in their first position, the lateral distance therebetween the wall biting ends is slightly less than the thickness of the pipe wall 94 of the broken column pipe 95. While the pivot arms 72 and 80 occupy their downwardly pivoted first positions, and upon upward extension of the pipe wall 94 of the broken column pipe 95 into the pipe wall receiving space 8,34,50, the wall biting ends 81 of the pivot arms 72 and 80 contact and frictionally slide over the inner and outer surfaces of the pipe wall 94. Such frictional contact pivotally moves or wedges apart the pivot arms 72 and 80 from their lower first positions to upwardly angularly displaced second positions within the pipe wall receiving space 8,34,50. Such second positions of the pivot arms 72 and 80 preferably comprises over center orientations wherein the distal wall biting ends 81 of the pivot arms 72 and 80 are positioned at an elevation slightly above that of the axes of rotation of the pivot bearings 74 and 84. Such over center second position orientations advantageously permit upward travel of the column pipe wall 94 within the pipe wall receiving space 8,34,50 while performing a frictional wall biting or clamping function which prevents any downward withdrawal of such pipe wall.

Referring to all figures, the laterally spaced tines 30, 32, 46 and 48 of the second and third sub-forks/cover plates 28 and 44, advantageously further constitute and function as means for downwardly pivotally biasing the pivot arms 72 and 80 toward their first positions. Gravity is a preferred biasing means motive force, the weight of the tines 30, 32, 46, and 48 being transferred to the pivot arms 72 and 80 via connector posts or pins 54 and 56. Such posts preferably extend through the laterally oblongated eyes 76 and 82 of the pivot arms 72 and 80, and also extend through the travel slots 16 and 20 within the first sub-fork 2. Post 54 preferably has a helically threaded hollow bore and has a base end which is fixedly and rigidly mounted so that it extends inwardly from the inner surface of tine 46. The post 54 preferably has a height or length dimension which is slightly greater than the thickness of the first sub-fork, and the opposite cantilevered end of the post 54 preferably directly abuts the opposite inner surface of tine 30 and directly underlies an eye 36 which extends therethrough. A helically threaded screw 62 extends through the eye 36 and engages the internal helical threads of the post 54. Tightening of the screw 62 conveniently provides an easily disassembleable and rigid interconnection between tines 30 and 36, such connection extending through the eye 76 of the pivot arm 72 and through the travel slot 16 of the first sub-fork/interstitial plate 2. The downwardly directed weight of the tines 30 and 46 against the pivot arm 72 is transferred via the post 54 to the wall of the eye 76, and such weight normally downwardly pivots and biases the pivot arm 72. A similarly configured post 56 which extends from tine 48 and is removably secured by a screw 70 extending through eye 43. Like the post 54, the post 56 downwardly biases pivot arm 80 to its first position.

Additional vertically oblongated travel slots 10, 12, and 14 extending through the first sub-fork/interstitial plate 2 are preferably provided. Also, further internally helically threaded connector posts 52, 58 and 60 preferably span between the second and third sub-forks/cover plates 28 and 44, such posts being secured in a fashion similar to posts 54 and 56 via screws 64, 68, and 66, which respectively extend through eyes or apertures 38, 42, and 40 within the first sub-fork/cover plate 28. Such additional travel slots, posts, and screws and eyes advantageously secure and configure the sub-forks 28 and 44 as a bracket which slidably captures the lower end of the first sub-fork/interstitial plate 2. The second and third sub-forks 28 and 44, as releasably held by the combinations of posts 52, 54, 58, and 60, and screws 64, 62, 70, 72, and 66 allows such sub-forks to oppositely overlie and slidably "sandwich" the first sub-fork 2, and to function as a covers or closures with respect to the inwardly opening travel slots 16 and 20. Such covering and closing function advantageously captures the bearings 74 and 84 of the pivot arms 72 and 80 within their bearing sockets 18 and 22.

Referring further simultaneously to all figures, the post and screw combinations 52 and 64, 54 and 62, 56 and 70, 58 and 68, and 60 and 66 advantageously comprise mounting means which slidably interconnect the first, second, and third sub-forks, such means positioning the second and third sub-forks on opposing sides of the first sub-fork. As the pivot arms 72 and 80 reciprocatingly move between their first and second positions, the second and third sub-forks or cover plates 28 and 44 correspondingly vertically move along travel slots 10, 12, 14, 16, and 20 between first and second positions with respect to the first sub-fork or interstitial plate 2.

In use of the instant inventive catch tool 1. A rope 96 is preferably secured to the upper end of the tool 1 through a provided rope attachment eye 26. The tool 1 may then be lowered into the bore 92 of a water well casing 90 until the flared lower end 24 of the tool 1 resides at or about the elevation of the broken upper end of a well column pipe 95. An operator may then repeatedly slightly raise and lower the tool 1 until the column pipe wall 94 enters the pipe wall receiving space 8,34,50. Upon such entry, the pivot arms 72 and 80 pivotally move from their downwardly biased first positions to their slightly upwardly pivoted and over centered second positions. Such upward entry of the column pipe wall 94 continues until its upper edge impinges against the lateral transition between the tines. At such point, downward motion of the tool 1 with respect to the well column pipe 94 ceases, and at such point, a biting, binding, or clamping effect imposed by the biting ends 81 of the arms 72 and 80 upon opposite surfaces of the wall 94 prevents any opposite disengaging motion of the wall 94 out of the space 8,34,50. At such point, the well column pipe 94 is securely captured and held by the tool 1, and an operator may utilize the rope 96 to pull the well column pipe 95 and attached submersible electric pump (not depicted within view) to the upper opening of the well.

In some circumstances, it may be desirable to release the tool 1 from the well column pipe 95 rather than continuing to attempt to haul the tool and the well column pipe to the surface. In order to facilitate such function, a loop 42 attached to the second sub-fork 28 (or alternatively to the third sub-fork 44) may be provided, and a cord 98 attached to such loop may also be provided. Suitably, the loop 42 may be alternatively configured as an outwardly angled eye tab (not depicted) presented at the upper end of the second or third sub-fork. Provided that the cord 98 extends to the surface, the operator may simply pull upwardly thereon causing sub-forks 28 and 44 along with posts 52, 54, 56, 58, and 60 to travel upwardly along their travel slots 12, 16, 20, 14, and 10 within the first sub-fork 2. Upon such relative sliding travel of such sub-forks, posts 54 and 56 bias against upper surfaces of laterally oblongated eyes 76 and 82 extending through pivot arms 72 and 80, causing those pivot arms to pivot upwardly toward their second positions, and causing the inward or distal wall biting ends 81 of such arms to disengage from the inner and outer surfaces of the pipe wall 94. Upon such disengagement, the tool 1 may be freely pulled upwardly and away from the broken well column pipe 95.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. A catch tool for retrieval of a well column pipe, the well column pipe having a pipe wall, the pipe wall having a thickness dimension, the catch tool comprising:

(a) a fork having a pair of tines, the tines being spaced apart for receipt of the pipe wall; and (b) clamping means connected operatively to the fork, the clamping means being adapted for, upon the receipt by the tines of the pipe wall, grasping the pipe wall; the clamping means comprising a pair of arms, each arm having proximal and distal ends, each arm's proximal end being fixedly attached to one of the fork's tines, the arms' fixed attachments being adapted for facilitating pivoting movements between first and second positions, the arms' distal ends being displaced away from each other a distance less than the pipe wall's thickness dimension while in the first position, the arms' distal ends, upon the receipt by the tines of the pipe wall, being carried by the pipe wall to their second positions; and (c) gravity actuated biasing means connected operatively to the arms, the biasing means being adapted for normally moving the arms toward their first positions, the biasing means comprising a pair of weights, each weight being fixedly attached to one of the arms.

2. The catch tool of claim 1 wherein the weights' fixed attachments comprise pin and eye joints.

3. The catch tool of claim 2 wherein each pin and eye joint is positioned between the proximal and distal ends of one of the arms.

4. A catch tool for retrieval of a well column pipe, the well column pipe having a pipe wall, the pipe wall having a thickness dimension, the catch tool comprising:

(a) first, second, and third forks, the first fork having a pair of opposing sides, and each fork comprising a pair of tines, each pair of tines being spaced apart to define a pipe wall receiving space;

(b) mounting means interconnecting the first, second, and third forks, the mounting means positioning the second and third forks on opposite sides of the first fork, the mounting means being adapted for facilitating motions of the second and third forks between first and second positions with respect to the first fork; and (c) clamping means connected operatively to the first, second, and third forks, the clamping means being adapted for alternatively closing and opening within the pipe wall receiving space upon motions of the second and third forks between their first and second positions.

5. The catch tool of claim 4 wherein mounting means comprises a plurality of travel slots and a plurality of posts, each travel slot extending through the first fork and each post interconnecting the second and third forks and extending though one of the travel slots.

6. The catch tool of claim 5 wherein the clamping means comprises a pair of arms, each arm having a proximal end and a distal end cantilevering into the pipe wall receiving space, each arm's proximal end being pivotally mounted upon one of the first fork's tines.

7. The catch tool of claim 6 wherein the clamping means further comprises a pair of eyes, each eye extending through one of the arms and being positioned between said one arm's proximal and distal ends, and wherein each eye receives one of the posts among the plurality of posts.

8. The catch tool of claim 7 wherein each travel slot receiving one of the posts extending through one of the arms' eyes opens laterally at the pipe wall receiving space.

9. A catch tool for retrieval of a well column pipe, the well column pipe having a pipe wall, the pipe wall having a thickness dimension, the catch tool comprising:

(a) an interstitial plate and a pair of laterally inwardly opening travel slots positioned upon the interstitial plate, each laterally inwardly opening travel slot having a laterally outer wall;

(b) a pair of cover plates oppositely overlying the laterally inwardly opening travel slots; and (c) a pair of pivot arms, each pivot arm having a proximal end and a pipe wall biting distal end, each pivot arm's proximal end being mounted upon the laterally outer wall of one of the laterally inwardly opening travel slots, the pivot arms being moveable between first and second positions, the pivot arms' wall biting distal ends being laterally displaced from each other a distance less than the pipe wall's thickness dimension while in their first positions, the pivot arms, upon extension of the pipe wall between their wall biting distal ends, being thereby carried to their second positions; and further comprising slide means operatively interconnecting the cover plates, the pivot arms, and the interstitial plate so that the cover plates may move between first and second positions in unison with the pivot arms' motions between their first and second positions.

10. The catch tool of claim 9 wherein the slide means comprises a second plurality of travel slots and a plurality of posts, each travel slot among the second plurality of travel slots extending through the interstitial plate, and each post extending between the cover plates and through one of the travel slots among the laterally inwardly opening travel slots and second plurality of travel slots.

11. The catch tool of claim 10 further comprising a pair of eyes, each eye extending through one of the pivot arms, each arm receiving one of the posts.

12. The catch tool of claim 11 wherein the interstitial and cover plates form laterally spaced fork tines, the lateral space being fitted for receipt of the pipe wall.

* * * * *